US012017319B2

(12) United States Patent
Tian et al.

(10) Patent No.: US 12,017,319 B2
(45) Date of Patent: Jun. 25, 2024

(54) CONTROLLABLE MAGNETIC FIELD-ASSISTED FINISHING APPARATUS FOR INNER SURFACE AND METHOD

(71) Applicant: Shandong University of Technology, Zibo (CN)

(72) Inventors: Yebing Tian, Zibo (CN); Cheng Qian, Zibo (CN); Zenghua Fan, Zibo (CN); Zhiguang Sun, Zibo (CN)

(73) Assignee: Shandong University of Technology, Zibo (CN)

( * ) Notice: Subject to any disclaimer, the term of this patent is extended or adjusted under 35 U.S.C. 154(b) by 509 days.

(21) Appl. No.: 17/391,277

(22) Filed: Aug. 2, 2021

(65) Prior Publication Data

US 2022/0234158 A1 Jul. 28, 2022

(30) Foreign Application Priority Data

Jan. 26, 2021 (CN) ..... 202110101408.8

(51) Int. Cl.

| | |
|---|---|
| ***B24B 1/00*** | (2006.01) |
| ***B24B 31/10*** | (2006.01) |
| ***B24B 31/12*** | (2006.01) |
| ***B24B 41/06*** | (2012.01) |
| ***B24B 47/20*** | (2006.01) |

(52) U.S. Cl.

CPC ..... *B24B 1/005* (2013.01); *B24B 31/102* (2013.01); *B24B 31/12* (2013.01); *B24B 41/06* (2013.01); *B24B 47/20* (2013.01)

(58) Field of Classification Search

CPC ..... B24B 1/005; B24B 31/102; B24B 31/12; B24B 41/06; B24B 47/20; B24B 31/112; B24B 31/006; B24B 1/002; B24B 5/06; B24B 41/061; B08B 9/023; B08B 9/00

USPC ..... 451/36, 51, 39; 269/254 CS, 254 R

See application file for complete search history.

(56) References Cited

FOREIGN PATENT DOCUMENTS

| | | | | |
|---|---|---|---|---|
| CN | 108687573 A | * | 10/2018 | ..... B24B 1/005 |
| CN | 110170888 A | * | 8/2019 | ..... B24B 1/005 |

* cited by examiner

*Primary Examiner* — Laura C Guidotti
*Assistant Examiner* — Caleb Andrew Holizna
(74) *Attorney, Agent, or Firm* — JCIPRNET

(57) ABSTRACT

A controllable magnetic field-assisted finishing apparatus for an inner surface and a finishing method are provided. The apparatus includes a housing, ball screw mechanisms, a workpiece, a centering clamp, a connecting plate, a magnetic field generating device, a chuck clamp, a precise displacement platform and a base. The magnetic field generating device includes electromagnetic coils, coil connecting plates, a magnetic yoke, nuts, springs and bolts. The magnetic field generating device dynamically adjusts a distance from the magnetic yoke to the outer surface of the workpiece through the springs. The movement tracks of the magnetic finishing medium are controlled by the formed rotation of the magnetic field, the finishing action force dynamic-adjustment, the optimization of the machining form of the magnetic finishing medium in collaboration with the rotation of the chuck clamp and the feed movement of the precise displacement platform.

3 Claims, 4 Drawing Sheets

CONTROLLABLE MAGNETIC FIELD-ASSISTED FINISHING APPARATUS FOR INNER SURFACE AND METHOD

CROSS REFERENCE TO RELATED APPLICATION

This application claims priority to Chinese Application No. 202110101408.8, filed on Jan. 26, 2021, the content of which is incorporated herein by reference in its entirety.

TECHNICAL FIELD

The present disclosure relates to the field of magnetic field-assisted finishing techniques for an inner surface, and in particular, relates to a controllable magnetic field-assisted finishing apparatus for an inner surface and a method.

BACKGROUND ART

In fields such as aerospace, rail transit, precision machinery, biomedicine, food processing, and the like, high-purity liquid or gas is delivered through a very smooth inner surface. Typically, the usability and service lives of parts or components having the inner surfaces are closely related to the roughness of the inner surfaces thereof. The finishing is therefore becoming increasingly important as a last machining step. Currently, as a finishing technique that is most widely used, the magnetic field-assisted finishing mainly utilizes action at a distance to realize the finishing process for surfaces of workpieces, and the action at a distance is an effect of the auxiliary magnetic field on a high-permeability magnetic medium. Thus, the magnetic field-assisted finishing has advantages such as flexibility, controllability of the free grinding material and so on, which widely applies to the finishing process for high-performance parts such as parts having inner surfaces of an ultra-high-precision constraint, and precision parts having complex curved surfaces of a complex structure constraint. The magnetic field-assisted finishing mainly includes magnetic abrasive finishing, magnetorheological polishing, magnetorheological jet polishing, magnetic shear-thickening finishing, magnetic float polishing, etc. The permanent magnetic material is often used by the magnetic field-assisted finishing because of its wide magnetic hysteresis loop, high coercive force, high remanence, capability of providing a permanent magnetic field without the additionally applied current, low manufacturing cost, convenience in use and so on. However, the magnetic flux density of the permanent magnetic material is difficult to adjust, the dynamic balance of the permanent magnetic material is also difficult to control, and the movement mode of the permanent magnetic material is mechanical motion, so the application of the permanent magnetic material is limited in the field of the inner surface finishing to some extent. Moreover, with regard to the medium, the finishing medium for the magnetic abrasion has a poor flowability, and the magnetorheological fluid has a poor stability in the high-shear machining condition, which cannot ensure the quality of the inner surface finishing. Therefore, it is of great theoretical significance and practical application value to develop a controllable magnetic field-assisted finishing apparatus and a method for the inner surfaces of the parts or components, which has high efficiency, the high quality, the localization and the intelligence.

SUMMARY

The present disclosure provides a controllable magnetic field-assisted finishing apparatus for an inner surface and a finishing method. An energizing sequence as well as the current values and frequency values of the electromagnetic coils are changed, so the magnetic finishing medium forms multiple movement tracks by the formed rotation of the magnetic field, the finishing action force adjustment, the optimization of the machining form of the magnetic finishing medium in collaboration with the rotation of the chuck clamp and the feed movement of the precise displacement platform, so as to implement the finishing process, which is the high efficiency, the high quality, the localization and the intelligent, on the inner surfaces of the parts or components.

There provides a controllable magnetic field-assisted finishing apparatus for an inner surface and a finishing method. The controllable magnetic field-assisted finishing apparatus for the inner surface includes a housing, ball screw mechanisms, a workpiece, a centering clamp, a connecting plate, a magnetic field generating device, a chuck clamp, a precise displacement platform and a base; wherein the magnetic field generating device comprises electromagnetic coils, coil connecting plates, a magnetic yoke, nuts, springs and bolts; the magnetic field generating device is fixed, through the connecting plate, on one of the ball screw mechanisms that is located on a top of the housing; the magnetic yoke with a minute structure is fixedly connected to an end of each of the electromagnetic coils; the electromagnetic coils are fixedly connected to the coil connecting plates in one-to-one correspondence through corresponding ones of the bolts that are each mounted with the springs and the nuts; an end of the workpiece is fixed through the centering clamp and another end of the workpiece is clamped on the chuck clamp; and the centering clamp and the chuck clamp are fixedly connected to the precise displacement platform.

A finishing method is provided, which includes: placing a magnetic finishing medium in a region, which is to be processed, of an inner surface of the workpiece; fixing the workpiece through the centering clamp and the chuck clamp, to complete localization and clamping; and tightly attaching the magnetic field generating device to an outer surface of the workpiece through the springs; driving the magnetic field generating device by the one of the ball screw mechanisms to move to the region where the magnetic finishing medium is placed; operating the electromagnetic coils at a predetermined sequence, a predetermined current value and a predetermined frequency value, to generate a rotating magnetic field; and applying a finishing action force formed by the rotating magnetic field to the magnetic finishing medium; applying a drive signal to the chuck clamp and the precise displacement platform; performing a workpiece rotation; and making the precise displacement platform to perform a feed movement; implementing a relative movement between the magnetic finishing medium and the inner surface of the workpiece by cooperating the rotating magnetic field generated by the electromagnetic coils with the workpiece rotation and the feed movement of the precise displacement platform; changing in real time an energizing sequence as well as the predetermined current value and the predetermined frequency value of the electromagnetic coils based on a machining quality requirement on the inner surface of the workpiece and a roughness change during machining, to form another rotating magnetic field; dynamically adjusting another finishing action force applied to the magnetic finishing medium and optimizing a machining form of the magnetic finishing medium, in cooperation with a movement of the chuck clamp and a movement of the precise displacement platform, to make the magnetic finishing medium to form a plurality of movement tracks;

powering off the electromagnetic coils; and removing the magnetic finishing medium attached to the inner surface of the workpiece.

The embodiments have the following beneficial effects. First, the centering clamp and the chuck clamp are cooperatively used together with the magnetic field generating device, so workpieces of different shapes may be clamped and the finishing process of the inner surfaces thereof may be performed, thereby achieving the wide operability. Second, the magnetic field generating device dynamically adjusts a distance from the magnetic yoke to the outer surface of the workpiece through the springs, so a distance that the magnetic flux density is transferred to the inner surface of the workpiece may be shorten, the loss of the magnetic flux density to the finishing region may be reduced, and the finishing action force may be enhanced. Third, the energizing sequence as well as the current values and the frequency values of the electromagnetic coils may be changed in real time based on the finishing quality requirement on the inner surface of the workpiece and the roughness change during machining, to form different rotating magnetic fields, dynamically adjust the finishing action force applied to the magnetic finishing medium and optimize the machining form of the magnetic finishing medium. Fourth, the rotating magnetic field that is generated by the alternating electromagnetic coils, the rotation of the workpiece and the feed movement of the relative magnetic field generating device are cooperated, and thus the magnetic finishing medium forms multiple movement tracks, so as to implement the localized and intelligent finishing on the inner surface of the workpiece. Fifth, the electromagnetic coils are powered off upon the completion of the finishing, so that the magnetic flux density in the finishing region and the finishing action force on the inner surface disappear at the same time, and the magnetic finishing medium attached to the inner surface of the workpiece is easily removed or replaced.

DETAILED DESCRIPTION OF THE EMBODIMENTS

Example 1

Figure 1:
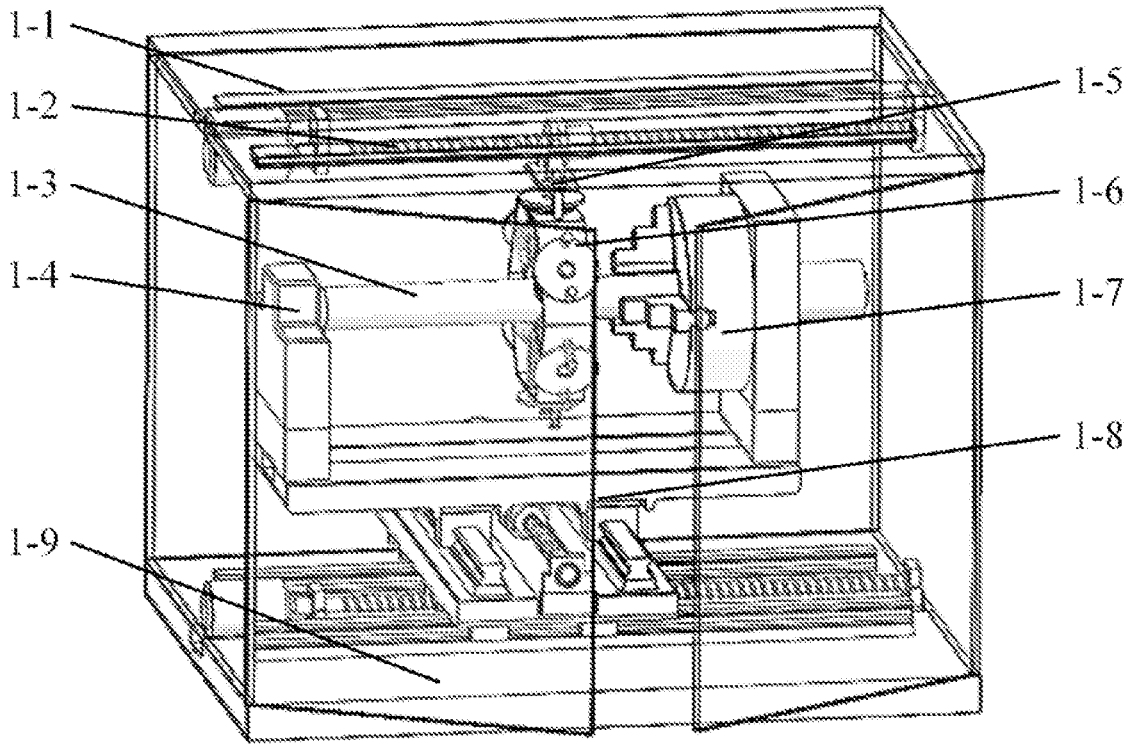
FIG. 1 is a schematic view showing an overall structure of a controllable magnetic field-assisted finishing apparatus for an inner surface according to an embodiment of the present disclosure.
Figure 2:
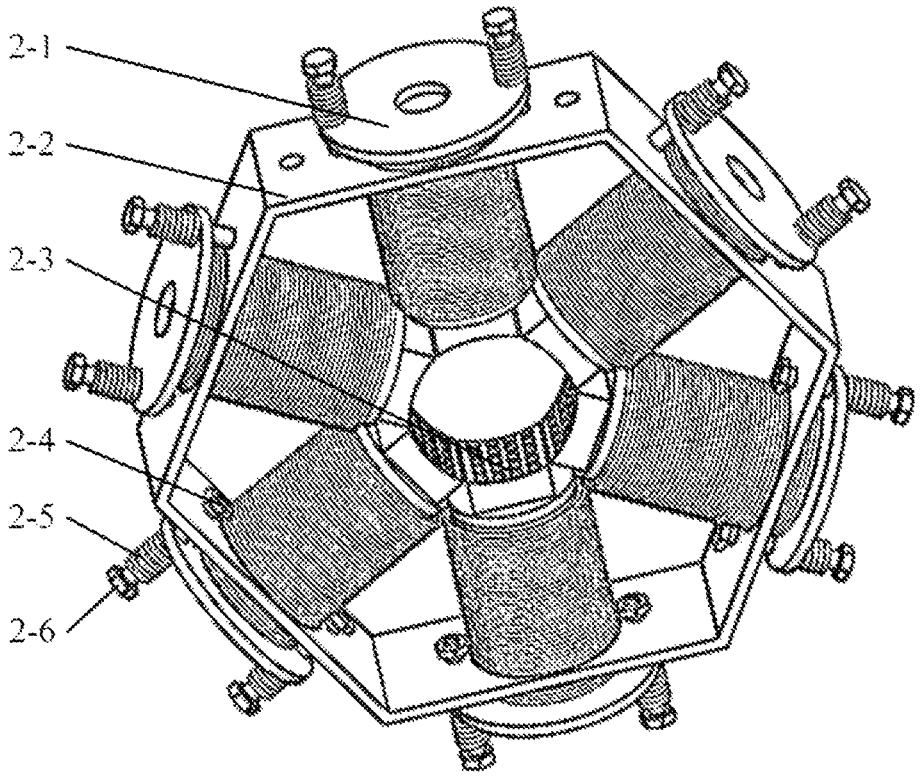
FIG. 2 is a schematic structural view of a magnetic field generating device of a controllable magnetic field-assisted finishing apparatus for an inner surface—according to an embodiment of the present disclosure.
Figure 3A:
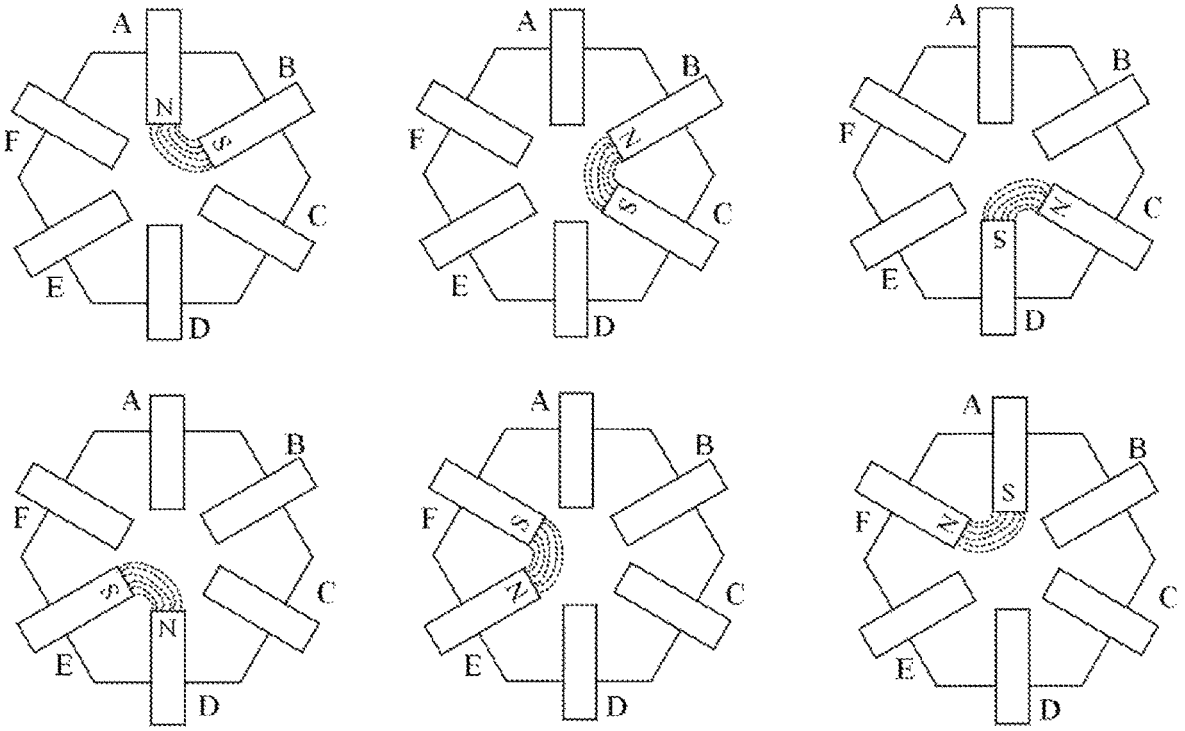
FIGS. 3(*a*)-3(*d*) are schematic views of a rotating magnetic field generated by energizing electromagnetic coils at different sequences, where the electromagnetic coils are included in a controllable magnetic field-assisted finishing apparatus for an inner surface-according to an embodiment of the present disclosure.
Figure 3B:
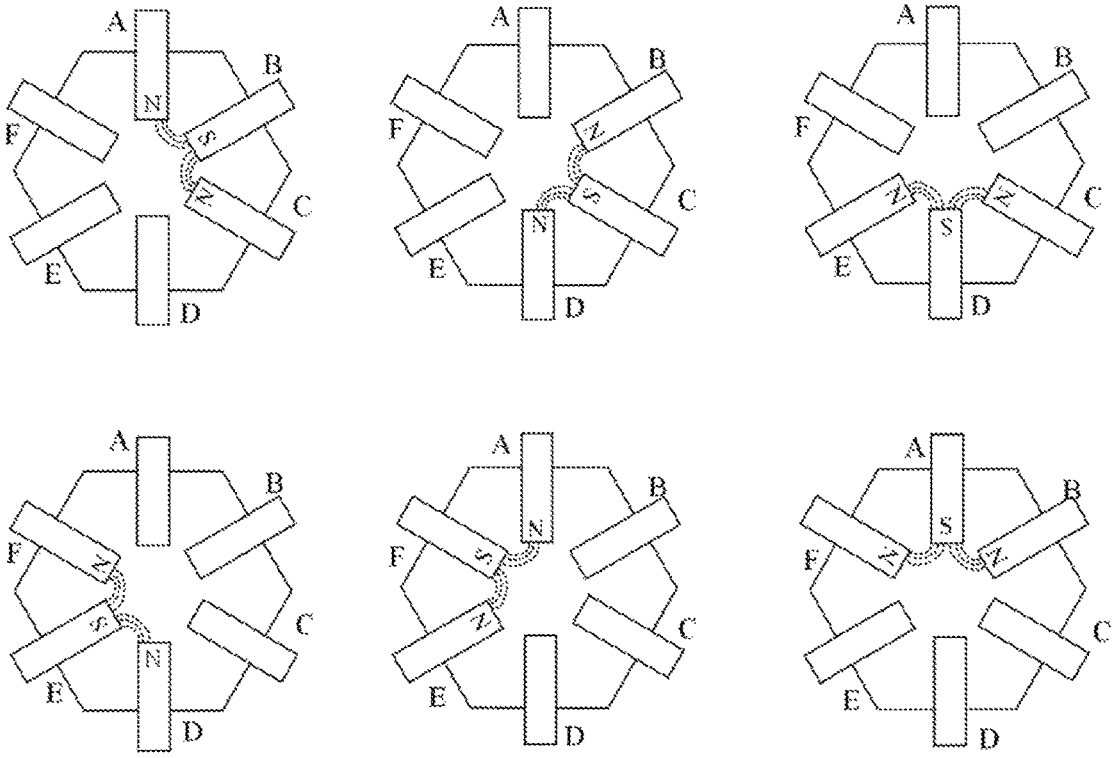
Figure 3C:
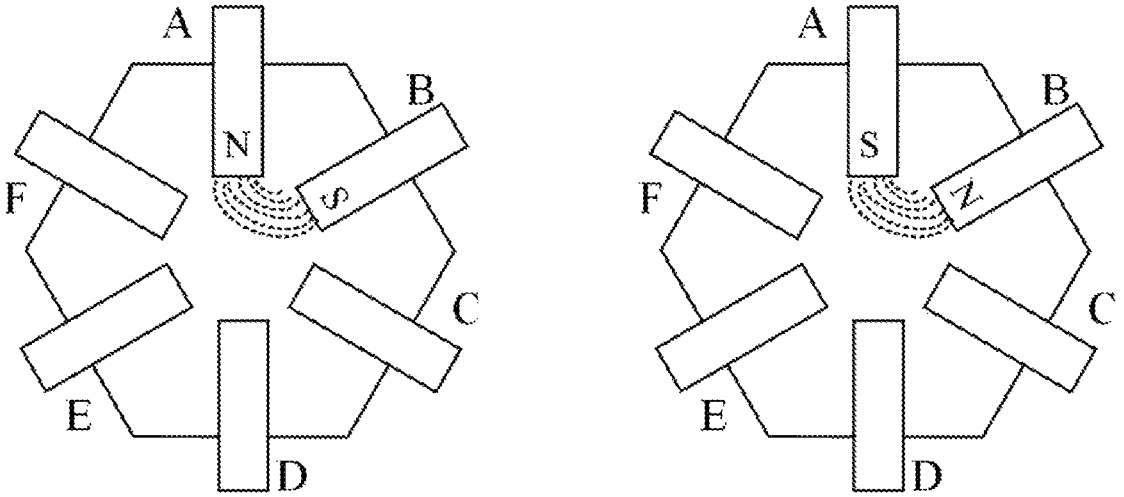
Figure 3D:
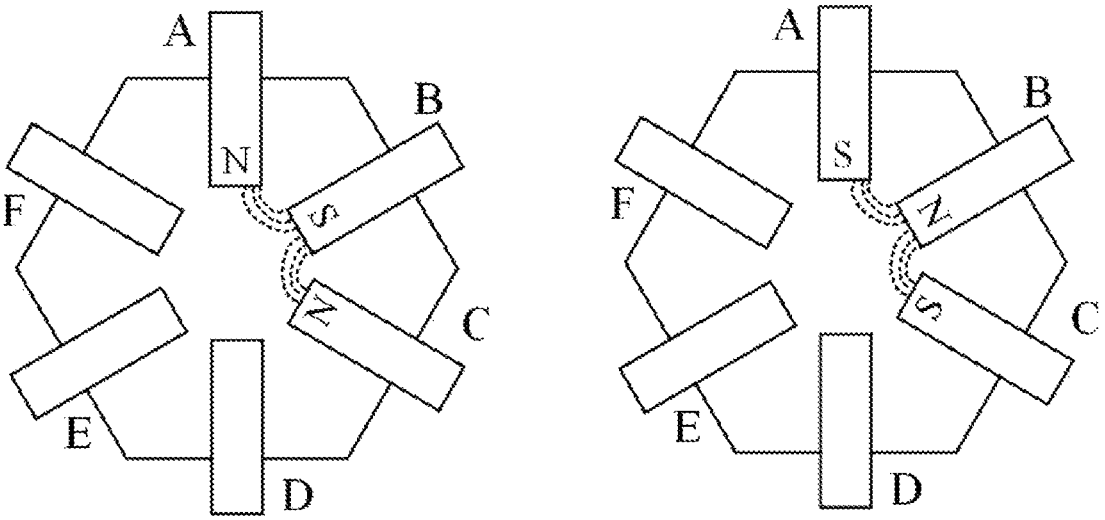

The apparatus is described in combination with FIG. 1 and FIG. 2, which includes a housing 1-1, ball screw mechanisms 1-2, a workpiece 1-3, a centering clamp 1-4, a connecting plate 1-5, a magnetic field generating device 1-6, a chuck clamp 1-7, a precise displacement platform 1-8 and a base 1-9. The magnetic field generating device includes electromagnetic coils 2-1, coil connecting plates 2-2, a magnetic yoke 2-3, nuts 2-4, springs 2-5 and bolts 2-6. The magnetic field generating device 1-6 is fixed, through the connecting plate 1-5, on the ball screw mechanism 1-2 placed on a top of the housing 1-1. The magnetic yoke 2-3 having a minute-structural feature is fixedly connected to an end of each of the electromagnetic coils 2-1. The electromagnetic coil 2-1 is fixedly connected to the coil connecting plate 2-2 through corresponding ones of the bolts 2-6 that are each provided with the springs 2-5 and the nuts 2-4. An end of the workpiece 1-3 is fixed through the centering clamp 1-4 and an other end of the workpiece is clamped on the chuck clamp 1-7. And the centering clamp 1-4 and the chuck clamp 1-7 are fixedly connected to the precise displacement platform 1-8.

Example 2

As shown in FIG. 1 and FIG. 2, the centering clamp 1-4 and the chuck clamp 1-7 are cooperatively used together with the magnetic field generating device 1-6, and thus workpieces 1-3 of different shapes may be clamped. The magnetic field generating device 1-6 dynamically adjusts a distance from the magnetic yoke 2-3 to the outer surface of the workpiece 1-3 through the springs 2-5, thereby shortening a distance that the magnetic flux intensity is transferred to the inner surface of the workpiece 1-3, reducing the loss of the magnetic flux intensity to the finishing region, and enhancing the finishing action force. Others are the same as Example 1.

Example 3

As shown in FIGS. 3(*a*)-3(*d*), different rotating magnetic fields are formed by changing an energizing sequence of the electromagnetic coils 2-1, thereby driving the magnetic finishing medium to rotate along the inner surface of the workpiece 1-3, and further performing the localized finishing on different machining regions. When the machining region is the whole inner surface of the workpiece 1-1, the energizing sequence may be $A\overline{B}$-$B\overline{C}$-$C\overline{D}$-$D\overline{E}$-$E\overline{F}$-$F\overline{A}$ or $A\overline{B}C$-$B\overline{C}D$-$C\overline{D}E$-$D\overline{E}F$-$E\overline{F}A$-$F\overline{A}B$, where $A\overline{B}$ represents that a positive current is charged to electromagnetic coil A to form an N pole and a negative current is charged to electromagnetic coil B to form an S pole; and the energizing of other electromagnetic coils is similar to the electromagnetic coils A and B. Rotating magnetic fields that are generated are respectively as shown in FIG. 3(*a*) and FIG. 3(*b*). When the machining region is a local part of the inner surface of the workpiece 1-1, the energizing sequence may be $A\overline{B}$-$B\overline{A}$ or $A\overline{B}C$-$\overline{A}B\overline{C}$, where $A\overline{B}$ represents that a positive current is charged to electromagnetic coil A to form an N pole and a negative current is charged to the electromagnetic coil B to form an S pole; and the energizing of other electromagnetic coils is similar to the electromagnetic coils A and B. The rotating magnetic fields that are generated are respectively as shown in FIG. 3(*c*) and FIG. 3(*d*). Current values and frequency values are changed in real time based on a machining quality requirement on the inner surface of the workpiece 1-3 and a roughness change during machining, to dynamically adjust a finishing action force and optimize a machining form of the magnetic finishing medium, thereby achieving the finishing that is the high quality, the high efficiency and the intelligent. Others are the same as Example 1 or Example 2.

Example 4

Figure 4:
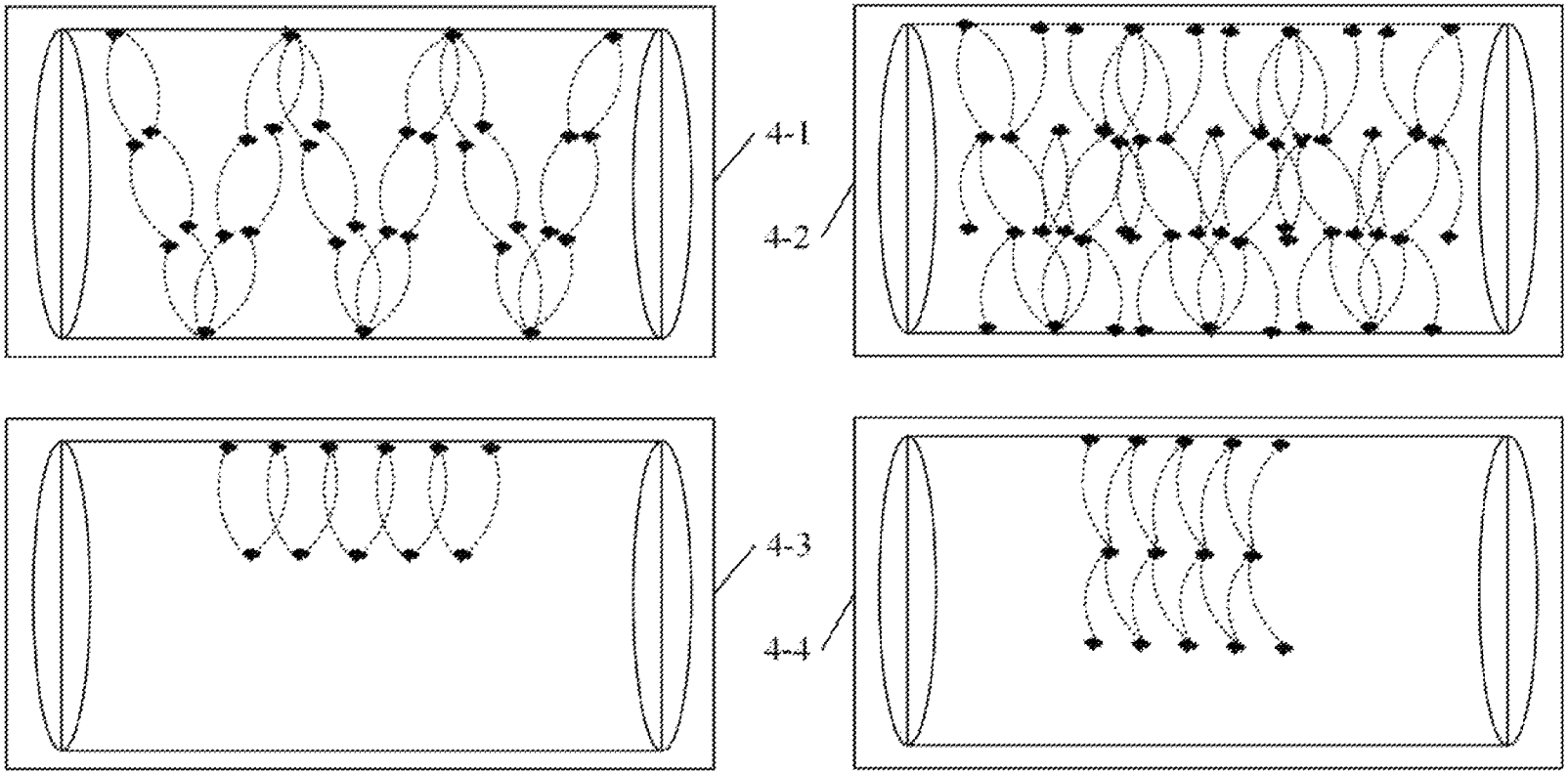
FIG. 4 is a schematic view of movement tracks of a magnetic finishing medium of a controllable magnetic field-assisted finishing apparatus for an inner surface—according to an embodiment of the present disclosure.

As shown in FIG. 1, FIG. 2, FIGS. 3(*a*)-3(*d*), and FIG. 4, after a drive signal is applied to the chuck clamp 1-7 and the precise displacement platform 1-8, the workpiece 1-3 rotates and the relative magnetic field generating device 1-6 performs a feed movement, in cooperation with the rotating magnetic field generated by the electromagnetic coils 2-1, the magnetic finishing medium forms multiple movement tracks for the selective localized finishing. After the drive signal is applied to the chuck clamp 1-7 and the precise displacement platform 1-8, the energizing sequence of the electromagnetic coils 2-1 is $A\overline{B}$-$B\overline{C}$-$C\overline{D}$-$D\overline{E}$-$E\overline{F}$-$F\overline{A}$ or $A\overline{B}C$-$B\overline{C}D$-$C\overline{D}E$-$D\overline{E}F$-$E\overline{F}A$-$F\overline{A}B$, and movement tracks 4-1, 4-2 formed by the magnetic finishing medium cover the whole inner surface of the workpiece 1-3, so as to implement the finishing on the whole inner surface of the workpiece 1-3. After the drive signal is applied to the precise displacement platform 1-8, the energizing sequence of the electromagnetic coils 2-1 is $A\overline{B}$-$B\overline{A}$ or $A\overline{B}C$-$\overline{A}B\overline{C}$, and movement tracks 4-3, 4-4 formed by the magnetic finishing medium cover the local part of the inner surface of the workpiece 1-3, so as to implement the localized finishing on the inner surface of the workpiece 1-3. Others are the same as Example 1, 2 or 3.

Example 5

As shown in FIG. 1, FIG. 2, FIGS. 3(*a*)-3(*d*), and FIG. 4, the electromagnetic coils 2-1 are powered off upon the completion of the finishing, so that the magnetic flux density in the finishing region and the finishing action force on the inner surface disappear at the same time, and the magnetic finishing medium attached to the inner surface of the workpiece 1-3 is easily removed or replaced. Others are the same as Example 1, 2, 3 or 4.

Example 6

As shown in FIG. 1, FIG. 2, FIG. 3 and FIG. 4, the finishing steps that are carried out by the apparatus described in any one of Example 1, 2, 3, 4 or 5 are as follows.

In step (1), a magnetic finishing medium is placed in a region, which is to be processed, of an inner surface of the workpiece 1-3.

In step (2), the workpiece 1-3 is fixed through the centering clamp 1-4 and the chuck clamp 1-7 to complete localization and clamping; and the magnetic field generating device 1-6 is tightly attached to an outer surface of the workpiece 1-3 through the springs 2-5.

In step (3), the magnetic field generating device 1-6 is driven by the ball screw mechanism (1-2) to move to the region where the magnetic finishing medium is placed.

In step (4), the electromagnetic coils 2-1 are operated at a predetermined sequence, a predetermined current value and a predetermined frequency value to generate a rotating magnetic field; and a finishing action force formed by the rotating magnetic field is applied to the magnetic finishing medium.

In step (5), a drive signal is applied to the chuck clamp 1-7 and the precise displacement platform 1-8; a rotation of the workpiece 1-3 is started; and the precise displacement platform 1-8 is made to perform a feed movement.

In step (6), a relative movement is implemented between the magnetic finishing medium and the inner surface of the workpiece 1-3 by cooperating the rotating magnetic field generated by the electromagnetic coils 2-1 with the rotation of the workpiece 1-3 and the feed movement of the precise displacement platform 1-8, for a high-efficiency and high-quality finishing.

In step (7), the energizing sequence as well as the predetermined current value and the predetermined frequency value of the electromagnetic coils 2-1 are changed in real time based on a machining quality requirement on the inner surface of the workpiece 1-3 and a roughness change during machining, to form another rotating magnetic field; another finishing action force applied to the magnetic finishing medium is dynamically adjusted and a machining form of the magnetic finishing medium is optimized, in cooperation with a movement of the chuck clamp 1-7 and a movement of the precise displacement platform 1-8 to make the magnetic finishing medium to form a plurality of movement tracks, so as to implement a localized and intelligent finishing on the inner surface of the workpiece 1-3.

In step (8), the electromagnetic coil 2-1 is powered off upon completing the finishing, so that a magnetic flux density in a finishing region and the finishing action force on the inner surface disappear at the same time; and the magnetic finishing medium attached to the inner surface of the workpiece 1-3 is removed.

What is claimed is:

1. A finishing method, the method being carried out by a controllable magnetic field-assisted finishing apparatus for an inner surface, the apparatus comprising:

a housing;
ball screw mechanisms;
a workpiece;
a centering clamp;
a connecting plate;
a magnetic field generating device;
a chuck clamp;
a displacement platform; and
a base;

wherein the magnetic field generating device comprises:
electromagnetic coils;
coil connecting plates;
a magnetic yoke;
nuts;
springs and bolts;

wherein:
the magnetic field generating device is fixed through the connecting plate on one of the ball screw mechanisms that is located on a top of the housing;
the magnetic yoke is fixedly connected to an end of each of the electromagnetic coils;
the electromagnetic coils are fixedly connected to the coil connecting plates in one-to-one correspondence through corresponding ones of the bolts that are each mounted with the springs and the nuts;
an end of the workpiece is fixed through the centering clamp;
another end of the workpiece is clamped on the chuck clamp; and
the centering clamp and the chuck clamp are fixedly connected to the displacement platform;

wherein the method comprises:
placing a magnetic finishing medium in a region, which is to be processed, of the inner surface of the workpiece;
fixing the workpiece through the centering clamp and the chuck clamp, to complete localization and clamping; and attaching the magnetic field generating device to an outer surface of the workpiece through the springs;

driving the magnetic field generating device by the one of the ball screw mechanisms to move to the region where the magnetic finishing medium is placed;

operating the electromagnetic coils at a predetermined sequence, a predetermined current value and a predetermined frequency value, to generate a rotating magnetic field; and applying a finishing action force formed by the rotating magnetic field to the magnetic finishing medium;

applying a drive signal to the chuck clamp and the displacement platform;

performing a workpiece rotation; and making the displacement platform to perform a feed movement;

implementing a relative movement between the magnetic finishing medium and the inner surface of the workpiece by cooperating the rotating magnetic field generated by the electromagnetic coils with the workpiece rotation and the feed movement of the displacement platform;

changing in real time an energizing sequence as well as the predetermined current value and the predetermined frequency value of the electromagnetic coils based on a machining quality requirement on the inner surface of the workpiece and a roughness change during machining, to form another rotating magnetic field; dynamically adjusting another finishing action force applied to the magnetic finishing medium and optimizing a machining form of the magnetic finishing medium, in cooperation with a movement of the chuck clamp and a movement of the displacement platform, to make the magnetic finishing medium to form a plurality of movement tracks; and powering off the electromagnetic coils; and removing the magnetic finishing medium attached to the inner surface of the workpiece.

2. A controllable magnetic field-assisted finishing apparatus for an inner surface, wherein the apparatus comprises:

a housing;

ball screw mechanisms;

a workpiece;

a centering clamp;

a connecting plate;

a magnetic field generating device;

a chuck clamp;

a displacement platform; and a base;

wherein the magnetic field generating device comprises:

electromagnetic coils;

coil connecting plates;

a magnetic yoke;

nuts, springs and bolts;

wherein:

the magnetic field generating device is fixed through the connecting plate on one of the ball screw mechanisms that is located on a top of the housing;

the magnetic yoke is fixedly connected to an end of each of the electromagnetic coils;

the electromagnetic coils are fixedly connected to the coil connecting plates in one-to-one correspondence through corresponding ones of the bolts that are each mounted with the springs and the nuts;

an end of the workpiece is fixed through the centering clamp;

another end of the workpiece is clamped on the chuck clamp; and the centering clamp and the chuck clamp are fixedly connected to the displacement platform.

3. The controllable magnetic field-assisted finishing apparatus for the inner surface according to claim 2, wherein the magnetic field generating device dynamically adjusts a distance from the magnetic yoke to an outer surface of the workpiece through the springs.

* * * * *